US006056613A

United States Patent [19]

Pike

[11] Patent Number: 6,056,613

[45] Date of Patent: May 2, 2000

[54] MULTI-PURPOSE FLOATATION DEVICE FOR RECREATION, EXERCISE, INSTRUCTION AND REHABILITATION PURPOSES

[76] Inventor: Karen Elise Pike, 6916 Saint Estaban St., Tujunga, Calif. 91042

[21] Appl. No.: 09/190,585

[22] Filed: Nov. 12, 1998

Related U.S. Application Data

[60] Provisional application No. 60/065,368, Nov. 12, 1997.

[51] Int. Cl.[7] ..... B63C 9/08

[52] U.S. Cl. ..... 441/129; 441/106; 441/108

[58] Field of Search ..... 441/80, 88, 102–129

[56] References Cited

U.S. PATENT DOCUMENTS

| | | | |
|---|---|---|---|
| 2,197,324 | 4/1940 | Sommers | 441/102 |
| 4,861,300 | 8/1989 | Casagrande et al. | 441/131 |

FOREIGN PATENT DOCUMENTS

| | | | |
|---|---|---|---|
| 11271 | 6/1901 | United Kingdom | 441/108 |

*Primary Examiner*—Ed Swinehart
*Attorney, Agent, or Firm*—Parsons & Goltry; Robert A. Parsons; Michael W. Goltry

[57] ABSTRACT

A recently popular form of exercise and therapy, aquatic exercising devices present unique operating conditions to the body because of their use of water resistance and their buoyancy. By making proper use of water resistance, such devices can provide the body with excellent muscular and cardiovascular training, at the same time, the buoyancy offered by these devices eliminates the stress and injuries associated with the jarring impact of such landbased exercises as running and aerobics. It is also an object of the present invention to provide an aquatic exercise devise that is a singular unit. The inventor began attending a water aerobic class in 1995 for health reasons. Exercising in the water took most of the pain out of the movement, but the inventor found that she was still hurting herself. She sought to reach a truly weightless state in which to condition her body. She tried the various devices provided by the pool facility but none proved effective in granting her the non-impact workout she was determined to find. With a problem to solve the inventor experimented, altered and designed a new and improved floatation device that is uniquely different in its adaptability to numerous applications. A uniquely different floatation device this invention goes beyond the restrictive designs of prior art designed to address one or another aspect of aquatic safety, exercise, rehabilitation or recreation. This invention adapts to usage in a multitude of expressions from water yoga, a unique synergy of ancient eastern culture and modern day technology; to aqua aerobic exercises incorporating cardiovascular enhancement activities; rehabilitation of physical injury or illness; as well as addressing the basic aspects of water safety and learning how to swim. A floatation device for various exercises, instruction, rehabilitation, therapeutic and/or recreational purposes; this invention provides floatation support as no other product on the market because of its unique design and flexibility and the multiple number of ways in which it can be used. With this invention its possible to float supine, moving through various water yoga relaxation movements and stretches; ride it like a bicycle seat; sit on it like a swing; wrap it around the torso and clip it on for deep water workout and/or for those who are uncomfortable in water, but who must get in for health and/or rehabilitation purposes; hold it with hands; slip it under arms, front to back, or back to front; all to move through various exercises for health, rehabilitation and fun. The variation is used to provide superior floatation in a clip on style. With this invention secured around the torso, up the chest and around the back of the neck, the wearer is provided with no-hands support. While wearing the invention the wearer can float forward to swim and learn strokes; tread water in an upright position; and/or float supine; all with complete range of motion of limbs and/or torso. This variation of the invention can be utilized in swimming instruction, pool safety, rehabilitation, recreation, instruction and general poolside safety.

11 Claims, 7 Drawing Sheets

MULTI-PURPOSE FLOATATION DEVICE FOR RECREATION, EXERCISE, INSTRUCTION AND REHABILITATION PURPOSES

CROSS-REFERENCE TO RELATED APPLICATIONS

This application claims the benefit of Provisional Patent Application Ser. No. 60/065,368 filed Nov. 12, 1997.

BACKGROUND FIELD OF INVENTION

The present invention relates to water floatation devices that have a plurality of buoyant segments to support a body for recreational, instructional, exercise, rehabilitation and/or therapeutic purposes. A recently popular form of exercise and therapy, aquatic exercising devices present unique operating conditions to the body because of their use of water resistance and their buoyancy. By making proper use of water resistance, such devices can provide the body with excellent muscular and cardiovascular conditioning.

With the stresses of modern society more and more individuals are in need of a new and improved method for relaxation and balancing in the human psyche and the physical muscular system. By combining the health benefits of yoga stretches, as well as the meditation and relaxation associated with yoga, along with the healing benefits of floating in warm water, this new and improved floatation device offers an avenue of rejuvenation of body, mind and spirit.

BACKGROUND DISCUSSION OF PRIOR ART

Prior personal floatation devices generally address only one or limited usage or utilizes several cumbersome pieces to achieve floatation support as in Kallassy U.S. Pat. No. 5,820,530. Whereas the above stated patent U.S. Pat. No. 5,820,530 utilizes six separate units to provide floatation, this invention provides floatation support in a singular unit.

Additionally the prior art is bulky, awkward in appearance and/or restricts free movement of the limbs and/or torso as in Bailey U.S. Pat. No. 5,030,153 in which the floatation support causes the wearer to bob about like a buoy with restricted mobility of torso and limbs.

The flexibility, versatility, and compactness of this invention have solved these problems.

OBJECTS AND ADVANTAGES

Figure 1:
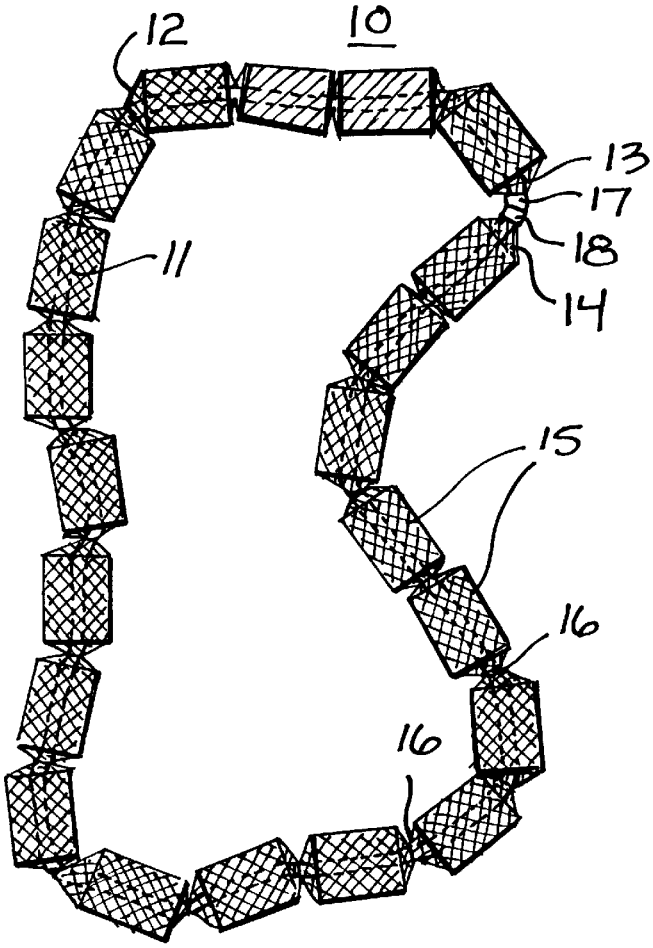
FIG. 1 is a perspective view of the new and improved floatation device of this invention.
Figure 2:
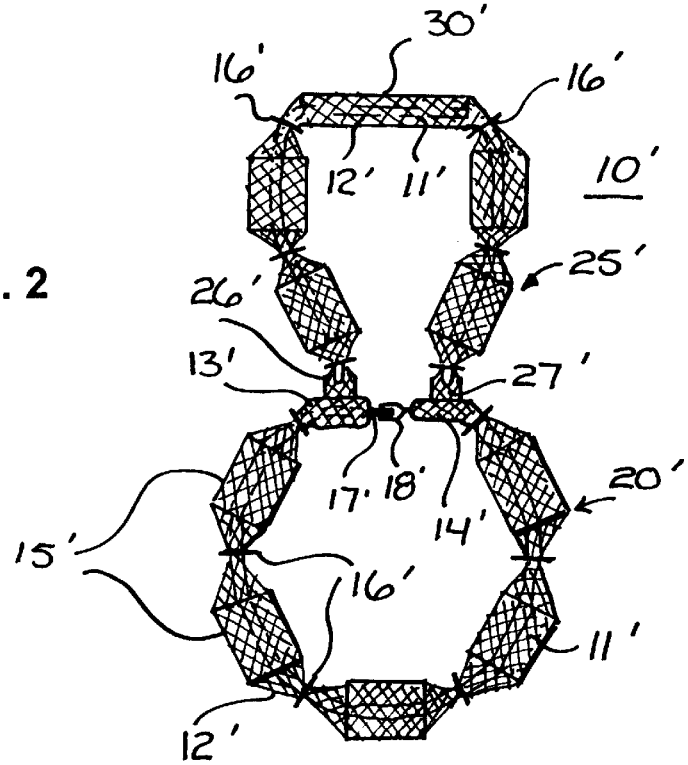
FIG. 2 is a perspective view of the new and improved floatation device of this invention shown in a clip on variation.
Figure 3:
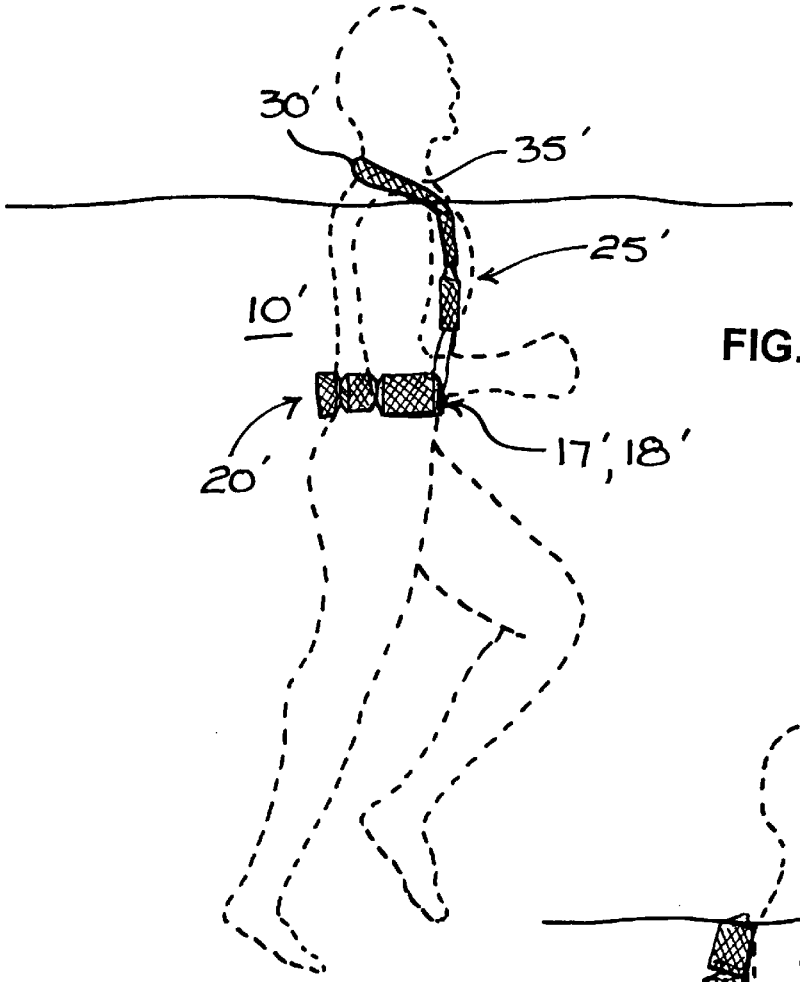
FIG. 3 is a perspective view of the new and improved floatation device of this invention in the clip on variation shown is use on a body.
Figure 4:
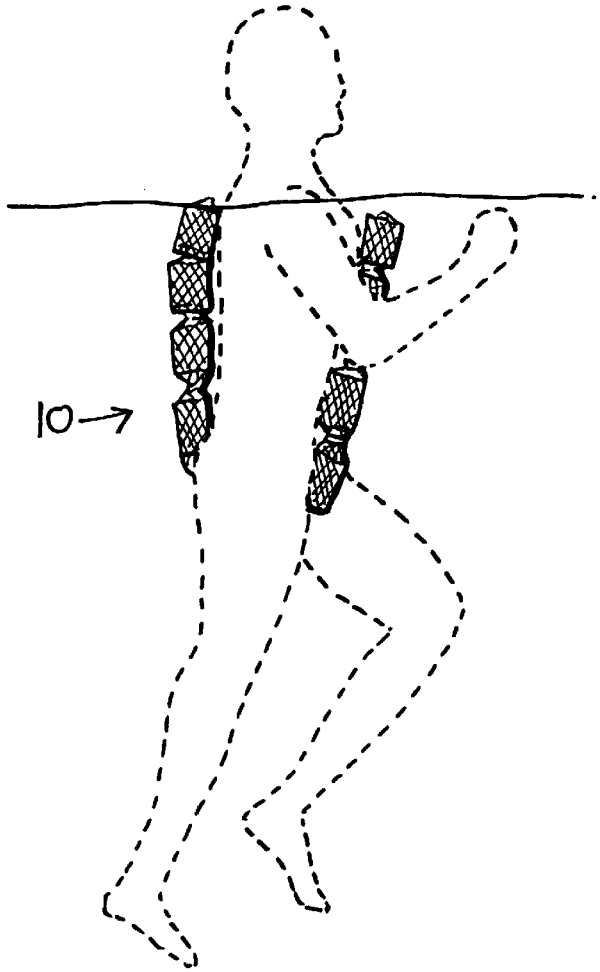
FIG. 4 is a perspective view of the new and improved floatation device of this invention shown in use as a bicycle seat like position by a human.
Figure 5:
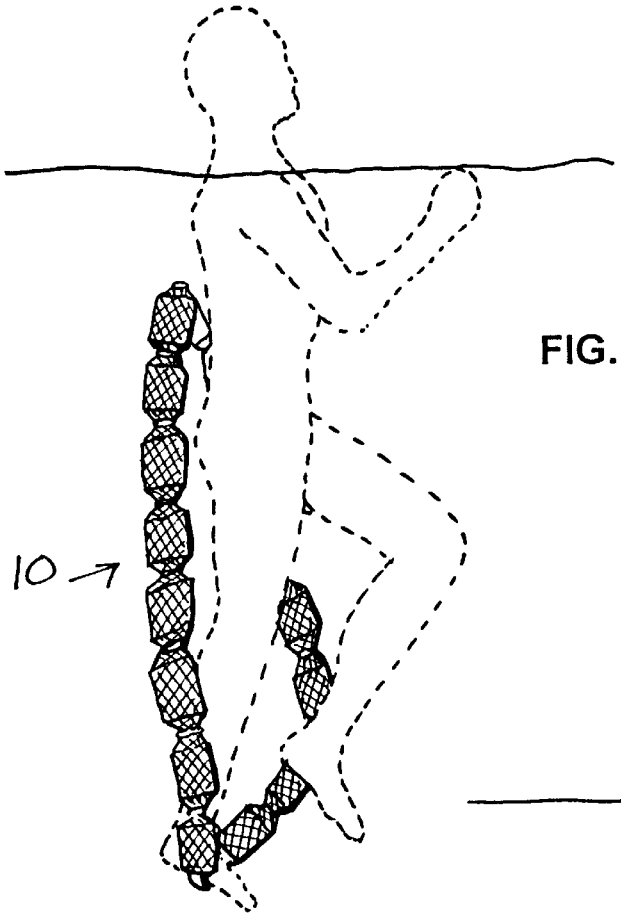
FIG. 5 is a perspective view of the new and improved floatation device of this invention shown in use as an instrument of a jogging dive in deep water.
Figure 6:
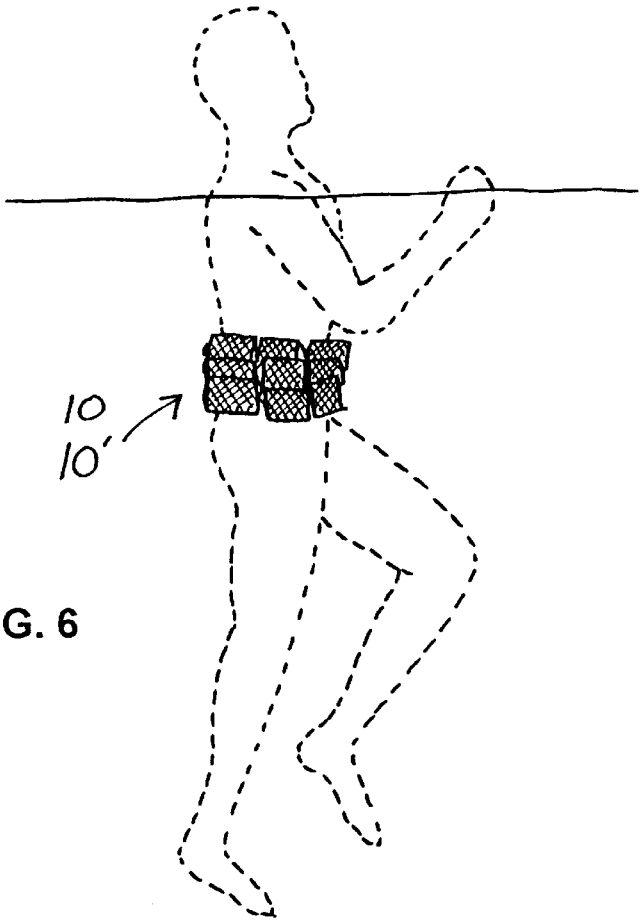
FIG. 6 is a perspective view of the new and improved floatation device of this invention shown in use as a floatation belt.
Figure 7:
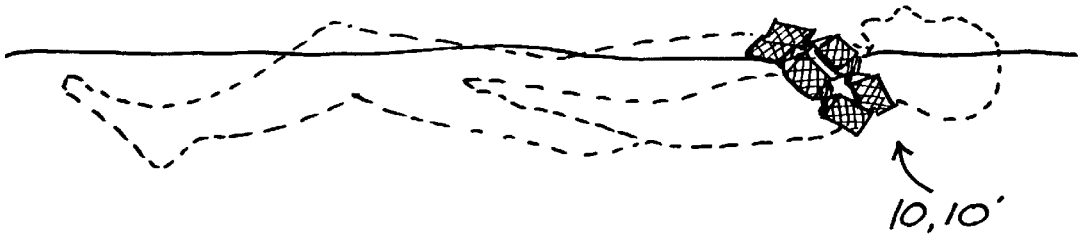
FIG. 7 is a perspective view of the new and improved floatation device of this invention shown in use as a floatation pillow.
Figure 8:
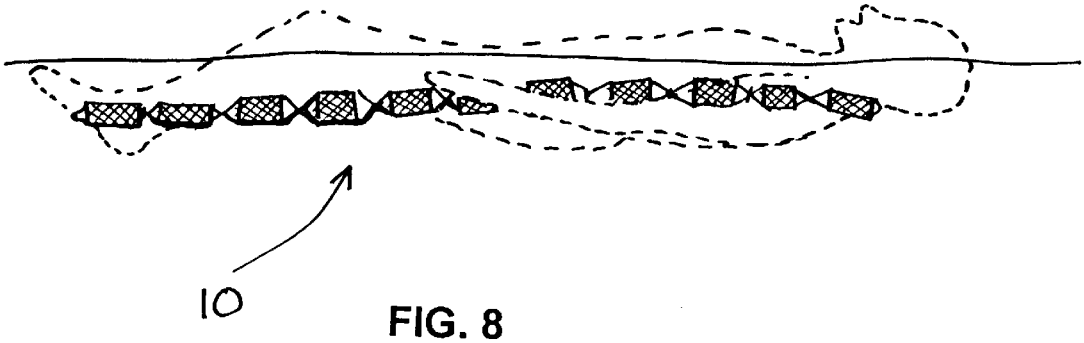
FIG. 8 is a perspective view of the new and improved floatation device of this invention shown in use as full body support of a body in a supine floating position.
Figure 9:
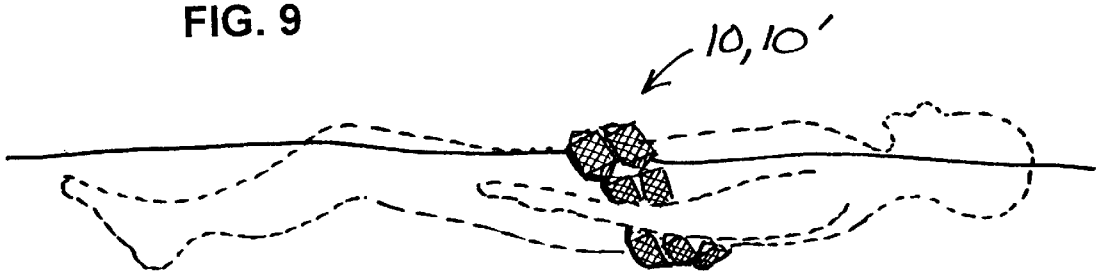
FIG. 9 is a perspective view of the new and improved floatation device of this invention shown in use as floatation support for the mid-section of a body.
Figure 10:
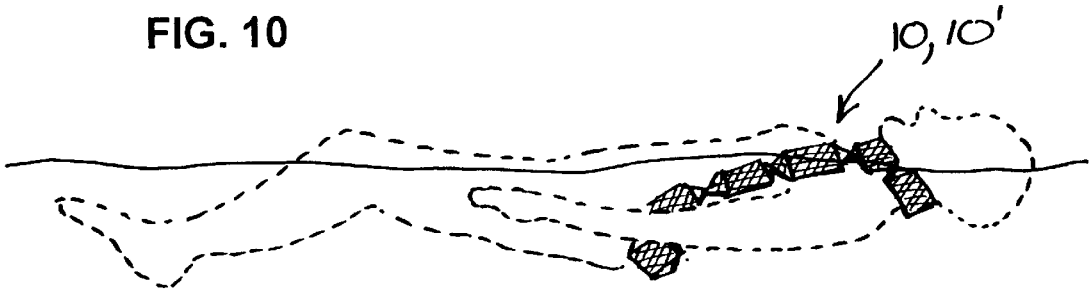
FIG. 10 is a perspective -view of the new and improved floatation device of this invention shown in use in an over the shoulder, behind the back floatation support of a body.
Figure 11:
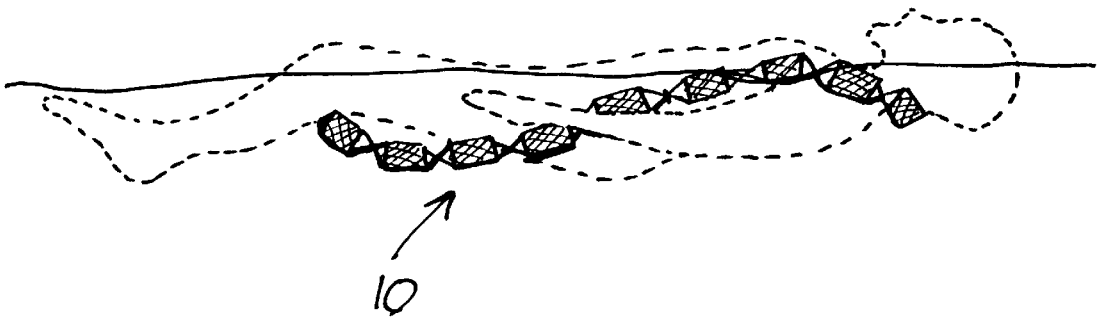
FIG. 11 is a perspective view of the new and improved floatation device of this invention shown in use in an over the shoulder, behind the legs floatation support of a body.
Figure 12:
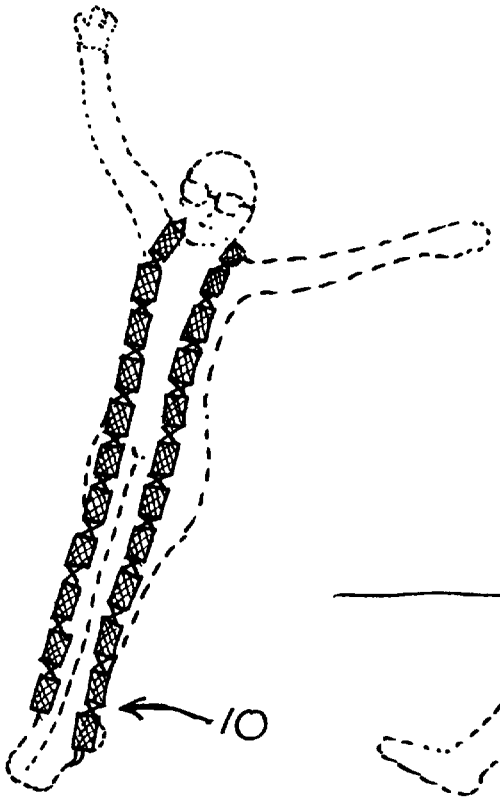
FIG. 12 is a perspective view of the new and improved floatation device of this invention shown in use as a full body floatation support of a body.
Figure 13:
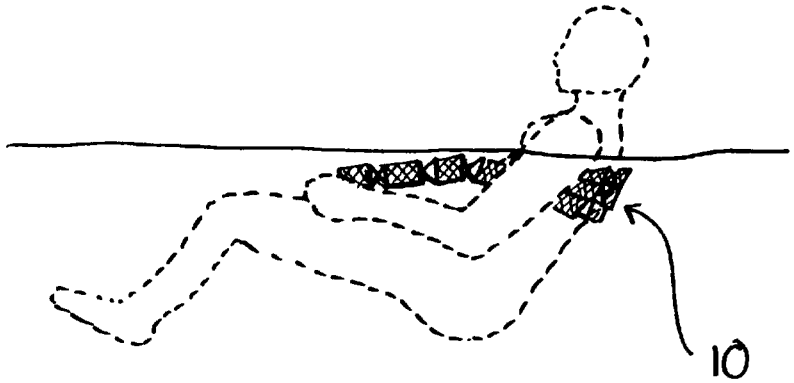
FIG. 13 is a perspective view of the new and improved floatation device of this invention shown in use stretched from left hand, around back, to right hand, providing floatation support for the user while performing various isometric exercises such as abdominal crunches in an aerobic workout.
Figure 14:
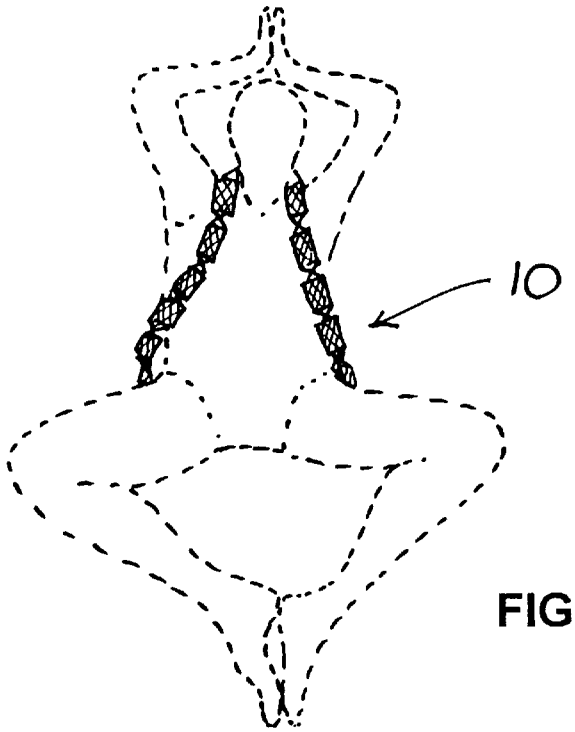
FIG. 14 is a perspective view of the new and improved floatation device of this invention shown in use as performing a water yoga stretch while being supported in a manner in which the floatation support is behind the neck, over the shoulders and behind the waist.
Figure 15:
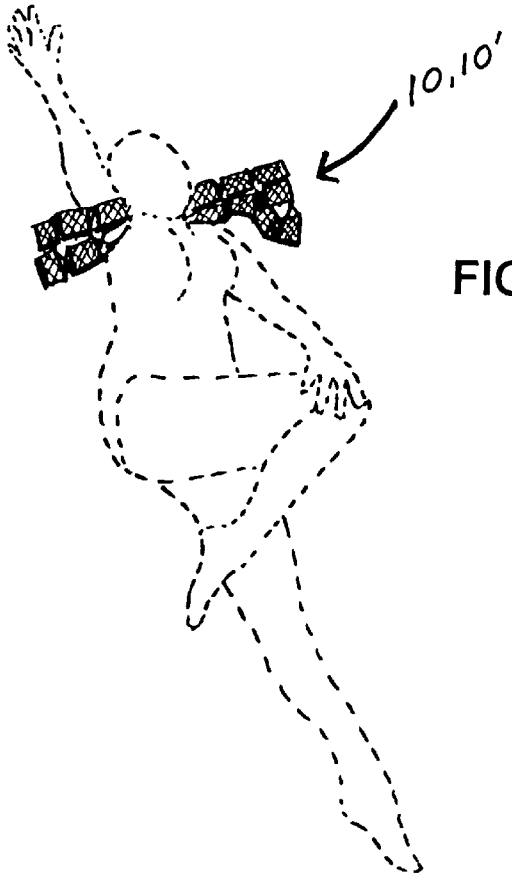
FIG. 15 is a perspective view of the new and improved floatation device of this invention shown in use as a floatation pillow.
Figure 16:
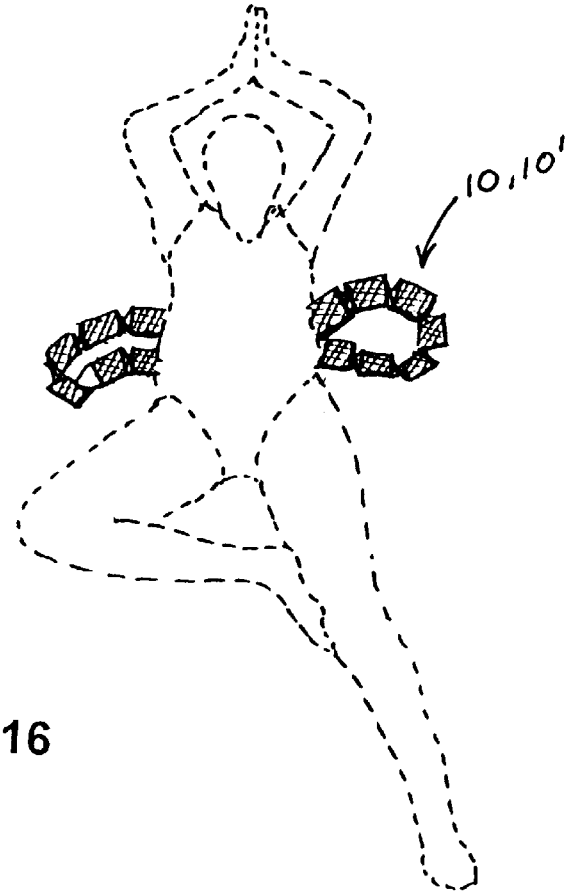
FIG. 16 is a perspective view of the new and improved floatation device of this invention shown in use as a floatation support at the torso of a body.

Accordingly, several objects and advantages of my invention are;

1. a new and improved floatation device to be implemented in performing water yoga stretches
2. to provide complete range of motion freedom and aquatic floatation support
3. superior clip on support for the wearer in the clip on variation
4. due to the flexibility this invention molds to the body as it moves through the water, comfortably cradling and supporting the body
5. because of its unique design this invention is more versatile in its uses, providing unparalleled freedom of movement and floatation support
6. yet another object of the invention is to allow the user to perform bicycling or other exercise in the water in a manner that allows the exact duplication of that exercise as performed on land, but without jarring of the joints
7. it is also an object of the present invention to provide an aquatic exercise device in a singular unit
8. superior for yoga exercise, isometric exercise, stretching, cardiovascular and aerobic exercise, as well as instructional, rehabilitation and safety uses.

DETAILED DESCRIPTION OF THE INVENTION How it is made:

Plural sections of buoyant material, approximately 2_inches in diameter and approximately 3 inches in length Length of stretchable, flexible tubing of desired length Flexible O-rings Material stitched into continuous sleeve of desired length Attachment means To construct:

Material cut into strips approximately 11 inches in width, 6 feet in length, stitched lengthwise to create a continuous sleeve Insert flexible, stretchable tubing into the sleeve Thread material and tubing through attachment means attachment orifice Use attachment means to clamp material and tubing together String buoyant material onto tubing inside material one at a time String flexible o-ring on top of tubing and material as a spacer between each segment of buoyant material Continue until desire length is attained Close opposite end in same manner as first end with attachment means to clamp material and tubing together and attach releasable closure means For clip on variation Material cut into strips approximately 11 inches in width. 6 feet in length, stitched lengthwise to create continuous sleeve, then cut approximately in half Insert flexible, stretchable tubing into first half of sleeve Thread material and tubing through attachment means Insert tubing into second half of sleeve Attach the two halves together with attachment means Continue adding buoyant material in said manner until desire length is achieved Leaving collar strap definition by an attachment means to delineate floatation section from collar section Use attachment means to connect chest/collar section to waist section Attach ends of waist section with a releasable closure means

I claim:

1. A multipurpose stretchable personal floatation device comprising:

elastic elongated tubing having opposed ends and being longitudinally stretchable;

a plurality of sections of buoyant material positioned on the tubing; and closure devices, one each attached to each of the opposed ends of the tubing and cooperating to form the tubing into an endless elastic loop stretchable between expanded and contracted positions, whereby the floatation device is movable by an individual between expanded and contracted positions for use in recreation, exercise, instruction, therapeutic, and rehabilitation purposes.

2. A multipurpose stretchable personal floatation device as claimed in claim 1 including in addition a sleeve of material with opposed ends with the tubing and buoyant material positioned therein.

3. A multipurpose stretchable personal floatation device as claimed in claim 2 including in addition spacers at least partially encircling and constricting the sleeve and tubing between adjacent sections of the plurality of sections.

4. A multipurpose stretchable personal floatation device as claimed in claim 3 wherein the spacers include flexible O-rings.

5. A multipurpose stretchable personal floatation device as claimed in claim 1 wherein the closure devices include a pair of mating releasable closure devices cooperating to form the tubing into an endless elastic loop in a closed position.

6. A multipurpose stretchable personal floatation device as claimed in claim 5 including in addition second elastic elongated tubing having opposed ends and a second plurality of sections of buoyant material positioned on the second elastic elongated tubing with spacers at least partially encircling and constricting the second elastic elongated tubing between two adjacent sections of the second plurality of sections to form a collar strap, and the pair of mating releasable closure devices, attaching the opposed ends of the second elastic elongated tubing to the opposed ends of the first elastic elongated tubing and cooperating to form the second elastic elongated tubing into an endless elastic loop in a closed position.

7. A multipurpose stretchable personal floatation device comprising:

elastic elongated tubing having opposed ends;

a plurality of sections of buoyant material positioned on the tubing;

a sleeve of material having opposed ends and surrounding the elastic elongated tubing and the plurality of sections of buoyant material;

spacers at least partially encircling and constricting the sleeve and tubing between adjacent sections of the plurality of sections to form a plurality of floatation elements elastically joined into a chain; and a pair of mating releasable closure devices, one each attached to each of the opposed ends of the sleeve and tubing and cooperating to form the chain into a continuous endless elastic chain in a closed position, the chain being movable between expanded and contracted positions.

8. A multipurpose stretchable personal floatation device as claimed in claim 7 wherein the spacers include flexible O-rings.

9. A multipurpose stretchable personal floatation device as claimed in claim 7 including in addition second elastic elongated tubing having opposed ends and a second plurality of sections of buoyant material positioned on the second elastic elongated tubing with spacers at least partially encircling and constricting the second elastic elongated tubing between two adjacent sections of the second plurality of sections to form a collar strap, and the pair of mating releasable closure devices, attaching the opposed ends of the second elastic elongated tubing to the opposed ends of the first elastic elongated tubing and cooperating to form the second elastic elongated tubing into an endless elastic loop in a closed position.

10. A method of fabricating a multipurpose stretchable personal floatation device comprising the steps of:

providing elastic elongated tubing having opposed ends, a sleeve of material, a plurality of sections of buoyant material, a plurality of spacers, and a pair of mating releasable closure devices;

inserting the tubing in the sleeve;

closing one end of the sleeve and tubing by attaching one of the pair of releasable closure devices to a first opposed end of the sleeve and the tubing;

threading the plurality of sections of buoyant material over the tubing in the sleeve, one section at a time, and placing a spacer of the plurality of spacers in an at least partially encircling and constricting position around the tubing and the sleeve to separate the plurality of sections into a plurality of floatation elements elastically joined into a chain; and closing the tubing and the sleeve by attaching another of the pair of releasable closure devices to a second opposed end of the tubing and the sleeve.

11. A method of fabricating a multipurpose stretchable personal floatation device as claimed in claim 10 wherein the step of providing the plurality of spacers includes providing a plurality of flexible O-rings and the step of placing the spacer of the plurality of spacers in an at least partially encircling and constricting position around the sleeve and the tubing to separate the plurality of sections into the plurality of floatation elements elastically joined into a chain includes the steps of threading a floatation element on the tubing within the sleeve and engaging a flexible O-ring over the sleeve intermediate each adjacent pair of floatation elements, after the threading of each floatation element over the tubing in the sleeve.

* * * * *